US009633771B2

(12) United States Patent
Salmon

(10) Patent No.: US 9,633,771 B2
(45) Date of Patent: Apr. 25, 2017

(54) MAGNETIC COUPLING DEVICE

(71) Applicant: I-BLADES, INC., Milpitas, CA (US)

(72) Inventor: Peter Colne Salmon, Mountain View, CA (US)

(73) Assignee: I-BLADES, INC., Milpitas, CA (US)

( * ) Notice: Subject to any disclaimer, the term of this patent is extended or adjusted under 35 U.S.C. 154(b) by 39 days.

(21) Appl. No.: 14/154,126

(22) Filed: Jan. 13, 2014

(65) Prior Publication Data

US 2015/0068014 A1 Mar. 12, 2015

Related U.S. Application Data

(60) Provisional application No. 61/751,936, filed on Jan. 13, 2013.

(51) Int. Cl.
*H01F 7/02* (2006.01)

(52) U.S. Cl.
CPC ..... *H01F 7/0252* (2013.01); *Y10T 29/49826* (2015.01)

(58) Field of Classification Search
CPC ..... H01F 7/0252
See application file for complete search history.

(56) References Cited

U.S. PATENT DOCUMENTS

| | | | |
|---|---|---|---|
| 3,786,391 A | 1/1974 | Mathauser | |
| 4,197,151 A * | 4/1980 | Muzik | B32B 27/18 156/152 |
| 5,921,783 A | 7/1999 | Fritsch et al. | |
| 6,871,047 B2 | 3/2005 | Iwata | |
| 7,329,128 B1 | 2/2008 | Awad | |
| 7,331,793 B2 | 2/2008 | Hernandez et al. | |
| 7,579,683 B1 | 8/2009 | Falik et al. | |
| 7,658,613 B1 | 2/2010 | Griffin et al. | |
| 7,885,685 B2 | 2/2011 | Himmelstein | |
| 8,138,869 B1 | 3/2012 | Lauder et al. | |
| 8,185,155 B2 | 5/2012 | Chang et al. | |

(Continued)

FOREIGN PATENT DOCUMENTS

| | | |
|---|---|---|
| WO | 2014036558 A2 | 3/2014 |
| WO | 2014036558 A3 | 4/2014 |

OTHER PUBLICATIONS

U.S. Appl. No. 14/017,000, "Final Office Action", Sep. 29, 2014, 7 pages.

(Continued)

*Primary Examiner* — Ramon M Barrera
(74) *Attorney, Agent, or Firm* — Kilpatrick Townsend & Stockton LLP

(57) ABSTRACT

A magnetic attachment comprises a stacked configuration including an attachment surface, a magnetic coupling device, and a device comprising at least one magnet. A thin non-conductive sheet may be positioned between the magnetic coupling device and the at least one magnet. The magnetic coupling device may include an aperture through which radio signals may pass. The magnetic coupling device may comprise alternating layers of magnetically permeable material and non-magnetically permeable material. The magnetic coupling device may have an adhesive backing layer and may be provided in a kit for a user to apply to a device. The embedded coupling device may be configured within the shell of a host device, or within a cover of a device.

16 Claims, 6 Drawing Sheets

(56) References Cited

U.S. PATENT DOCUMENTS

| | | | | |
|---|---|---|---|---|
| 8,242,868 | B2 | 8/2012 | Lauder et al. | |
| 8,348,678 | B2 | 1/2013 | Hardisty et al. | |
| 8,442,581 | B2 | 5/2013 | Chung et al. | |
| 8,529,247 | B2 | 9/2013 | Poe et al. | |
| 8,690,582 | B2 | 4/2014 | Rohrbach et al. | |
| 8,798,675 | B2 | 8/2014 | Salmon et al. | |
| 2007/0099603 | A1 | 5/2007 | Castres et al. | |
| 2009/0150547 | A1 | 6/2009 | Tripathi | |
| 2009/0212637 | A1 | 8/2009 | Baarman et al. | |
| 2010/0246771 | A1* | 9/2010 | Hawver ..... | G03B 42/02 378/98.2 |
| 2014/0065847 | A1 | 3/2014 | Salmon et al. | |
| 2014/0066128 | A1 | 3/2014 | Salmon et al. | |
| 2014/0240085 | A1 | 8/2014 | Salmon et al. | |

OTHER PUBLICATIONS

U.S. Appl. No. 14/017,000, "Non Final Office Action", May 23, 2014, 8 pages.
U.S. Appl. No. 14/017,000, "Restriction Requirement", Feb. 14, 2014, 7 pages.
U.S. Appl. No. 14/017,040, "Notice of Allowance", Feb. 6, 2014, 9 pages.
U.S. Appl. No. 14/271,376, "Non Final Office Action", Aug. 27, 2014, 7 pages.
U.S. Appl. No. 14/271,376, "Notice of Allowance", Dec. 24, 2014, 7 pages.
PCT/US2013/057846, "International Search Report and Written Opinion Received", Feb. 6, 2014, 13 pages.

* cited by examiner

MAGNETIC COUPLING DEVICE

CROSS-REFERENCES TO RELATED APPLICATIONS

This application claims priority to U.S. Provisional Patent Application No. 61/751,936, filed on Jan. 13, 2013, entitled "Magnetically and Electrically Coupled Devices, the disclosure of which is hereby incorporated by reference in its entirety for all purposes.

BACKGROUND OF THE INVENTION

Electronic devices may be connected using cables and connectors. An example of a popular serial data interface is THUNDERBOLT, capable of a transfer speed of 10 Gbit/second and available using copper wires in a cable and a MINI DISPLAYPORT connector.

Cables and connectors each have a significant manufacturing cost. They also require a user to carry them with their electronic equipment, to plug them in for use and to unplug them after use. In certain applications, particularly involving mobile devices, users may prefer a connection scheme that does not require cables and requirements for plugging and unplugging. For magnetically coupled devices, it may be desirable to create a magnetic anchor in a host device, to which an ancillary device can couple using embedded magnets. Thus, despite the progress made in electronic devices, there is a need in the art for improved methods and systems for physically interconnecting electronic modules and devices.

SUMMARY OF THE INVENTION

According to an embodiment of the invention an attachment method comprises the steps of: providing an attachment surface; providing a device having at least one embedded magnet; providing a magnetic coupling device; affixing the decal to the attachment surface; and releasably attaching the device to the magnetic coupling device using magnetic attraction between the embedded magnet and the magnetic coupling device. Further providing a thin non-conductive sheet between the magnetic coupling device and the embedded magnet. Further providing an aperture in the magnetic coupling device through which radio frequency signals may pass.

According to another embodiment of the invention, a magnetic coupling device comprises a first adhesive layer and a first layer of magnetically permeable material attached to the adhesive layer. An aperture through the first layer of magnetically permeable material may be provided for uninhibited transmission of radio waves through the coupling device. A layer of non electrically conducting material may be provided atop the layer of magnetically permeable material. The magnetic coupling device may include more than one layer of magnetically permeable material. A first layer of magnetically permeable material may be formed in the shape of a first toroid, a second layer of magnetically permeable material may be formed in the shape of a second toroid, and the lateral dimensions of the first toroid may extend beyond the lateral dimensions of the second toroid. The magnetically permeable material may have a relative permeability of at least 75,000. The thickness of a magnetically permeable layer may be in the range of 0.25-1.0 mm.

According to another embodiment of the invention an embedded magnetic coupling device comprises a host material that is non electrically conducting and a first magnetically permeable layer embedded in the host material. An aperture may be provided in a first magnetically permeable layer, or in a first and a second magnetically permeable layer. The embedded magnetic coupling device may include a first magnetically permeable layer formed in the shape of a first toroid and a second magnetically permeable layer formed in the shape of a second toroid. The first and second toroids may be configured with different lateral dimensions in order to reduce fringing magnetic fields and possible interference with the host device. The embedded magnetic coupling device may be configured wherein the layers of magnetically permeable material are contained in the shell of a host device, wherein the shell comprises a non electrically conductive material. The embedded magnetic coupling device may also be configured in a cover of a host device, and the cover may be releasable.

Various embodiments of the present invention are described hereinafter with reference to the figures. It should be noted that the figures are only intended to facilitate the description of specific embodiments of the invention. They are not intended as an exhaustive description of the invention or as a limitation on the scope of the invention. In addition, an aspect described in conjunction with a particular embodiment of the present invention is not necessarily limited to that embodiment and may be practiced in other embodiments. Additional embodiments may be achievable by combining the various elements in different ways. For example, the thin non-conductive sheet positioned between the magnetic coupling device and the one or more magnets of the attached device may be used with or without the radio frequency aperture in the decal, and with or without a stacked configuration of alternating magnetically permeable and non magnetically permeable layers.

DETAILED DESCRIPTION OF THE INVENTION

Figure 1:
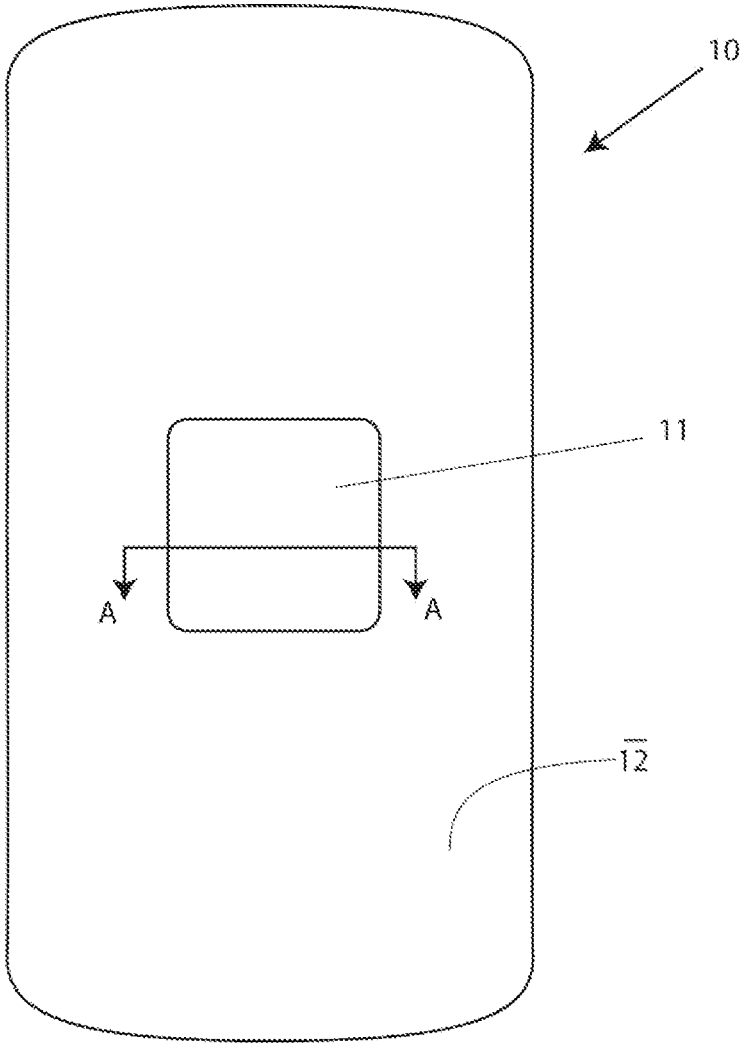
FIG. 1 is a plan view of a magnetic coupling device 11 affixed to the surface 12 of a host device 10.

FIG. 1 depicts a device 10 having an at attached magnetic coupling device 11, affixed to surface 12 of device 10. Magnetic coupling device 11 may be described as a magnetic decal. Device 10 may be a host device such as a mobile device or a docking station. The docking station may be part of a larger electronic system and it may be wall mounted. Thus magnetic coupling device 11 may be a component of a docking station.

Figure 2:
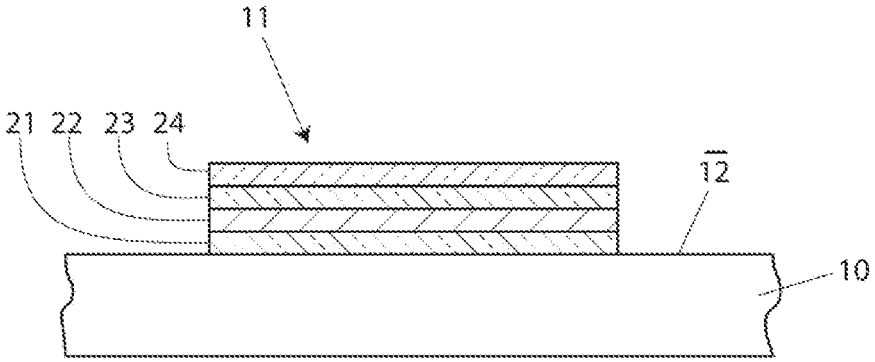
FIG. 2 is a cross-sectional view corresponding to section AA of FIG. 1. Device 11 includes a first adhesive layer 21, a layer 22 of magnetically permeable material, a second adhesive layer 23, and a layer of non electrically conducting material 24, to be further described.

FIG. 2 shows magnetic coupling device 11 in cross section, corresponding to section AA of FIG. 1. Device 11 is shown comprised of four layers in a stacked configuration. First, device 11 is affixed to surface 12 using adhesive layer 21, although any method of attachment may be used. Adhesive layer 21 may comprise VHB adhesive available from 3M Company for example. Second, layer 22 comprises a metallic foil or sheet comprising a magnetically permeable material such as a nickel iron alloy known as MU METAL. MU METAL typically has a relative permeability in the range of 80,000-100,000. PERMALLOY may also be used, having a typical relative permeability of 100,000. A typical thickness of layer 22 is 0.25-1.0 mm. Third, layer 23 comprises an adhesive layer similar to layer 21. Fourth, layer 24 comprises a non electrically conductive material such as a thin sheet of polycarbonate or polyacrylate, to be further described. The portion of device 10 shown in the figure may be part of an enclosing shell of the device; it may also be part of a cover for device 10, and the cover may be releasably attached to device 10. Layer 22 may be in the form of a foil or a sheet for example, and it may serve as a magnetic anchor for ancillary devices that may be attached to host device 10, to be further described. Magnetic coupling device 11 may be configured in a kit, wherein a user may apply the magnetic coupling device to a host device such as a smart phone. In this case, a liner may be provided with adhesive layer 21.

Figure 3:
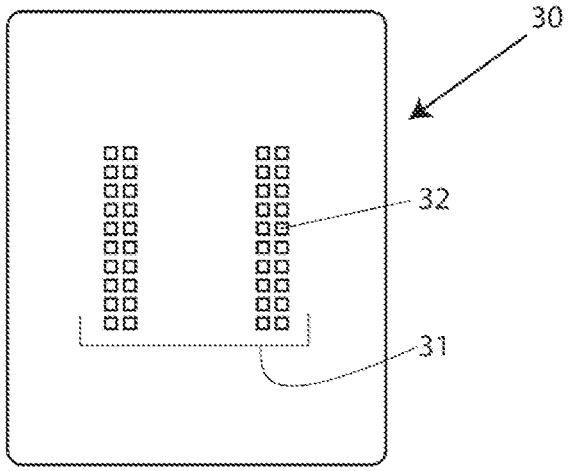
FIG. 3 is a plan view of a releasable module 30 having an array of magnets 32 comprising a magnetic contact array 31 embedded therein. Magnets 32 may be used as electrical terminals of module 30.

FIG. 3 illustrates a releasable module 30 that may be attached to a host device via a magnetic coupling device such as 11 of FIG. 2. Module 30 may contain a magnetic contact array 31 comprising magnets 32. The magnets may be neodymium magnets for example, and may have a total attraction (coupling) force in the range of 1-2 pounds when mounted using the magnetic attachments described herein.

Figure 4:
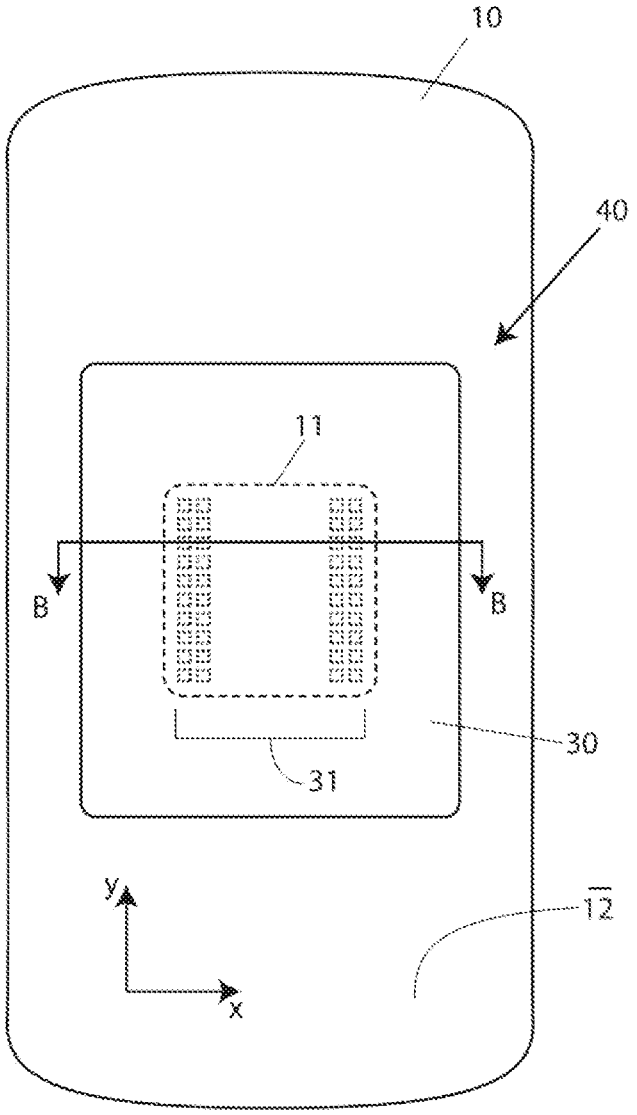
FIG. 4 is a plan schematic view of releasable module 30 magnetically coupled (attached) to host device 10 using magnetic coupling device 11 and the magnets 32 in contact array 31.

FIG. 4 schematically illustrates a magnetic attachment 40 comprising a stacking of host device 10, magnetic coupling device 11, and releasable module 30. The footprint of magnetic device 11 may be sized to match the dimensions of magnetic contact array 31, so that the location of releasable module 30 relative to host device 10 is constrained within a small distance, say within around 1 mm in the x and y directions.

Figure 5:
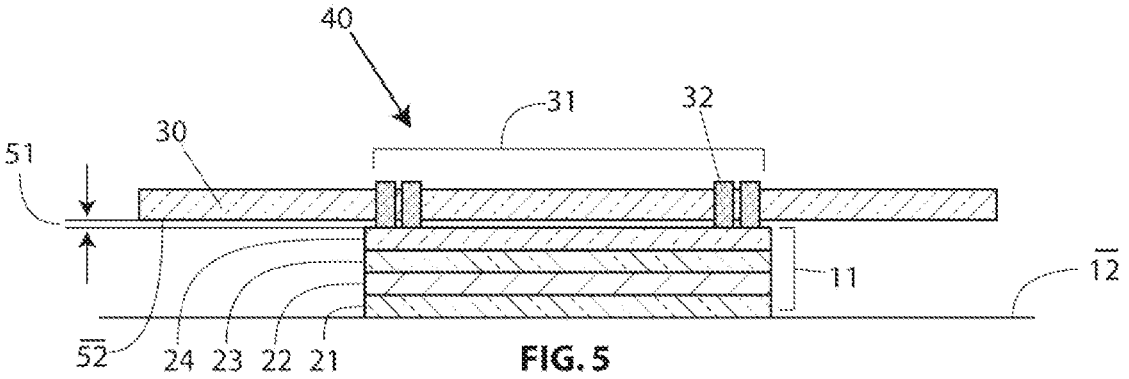
FIG. 5 depicts magnetic attachment 40 in a cross-sectional view corresponding to section BB of FIG. 4, showing magnets 32 of contact array 31 coupled to magnetic coupling device 11 which is affixed to surface 12 using an adhesive layer 21.

FIG. 5 depicts magnetic attachment 40 in cross-section, corresponding to section BB of FIG. 4. An optional protrusion 51 of magnets 32 beyond the embedding surface 52 is illustrated, having a atypical value of 0.1-0.2 mm. Magnetic coupling device 11 is shown comprised of four layers in a stacked configuration as described in reference to FIG. 2: layer 21 comprises an adhesive; layer 22 comprises a magnetically permeable material; layer 23 comprises an adhesive layer similar to layer 21; layer 24 comprises a non electrically conductive material. Layer 24 is included to prevent short circuiting of the magnets 32, one with another, in magnetic contact array 31, particularly when they are used as electrical terminals of releasable module 30.

Figure 5B:
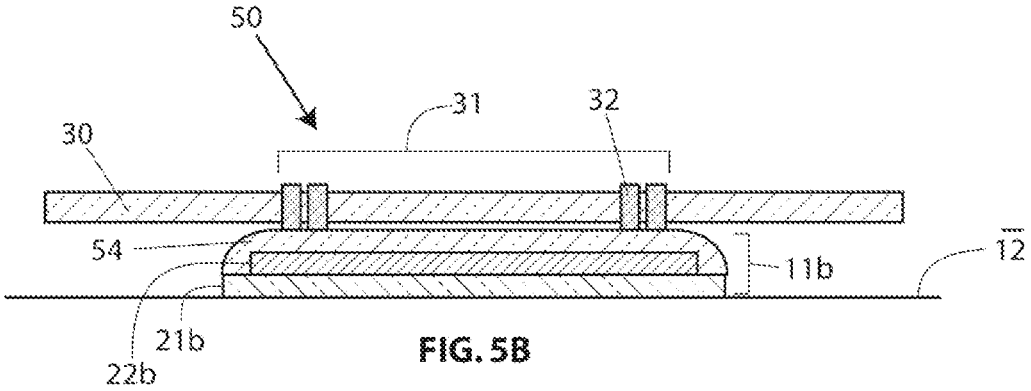
FIG. 5B is a cross-sectional view of magnetic attachment 50 comprising magnetic coupling device 11*b* which includes adhesive layer 21*b* and magnetically permeable layer 22*b*, wherein layer 22*b* is embedded in a molding 54 of non electrically conducting material.

FIG. 5B shows a magnetic attachment 50 comprising a magnetic coupling device 11*b* that is similar in function to device 11 of FIG. 5. Device 11*b* comprises an adhesive layer 21*b* and a layer 22*b* of magnetically permeable material that is embedded in a molding 54 during manufacture. Molding 54 comprises a non electrically conductive material, and this obviates the need for layers 23 and 24 of FIG. 5.

Figure 6:
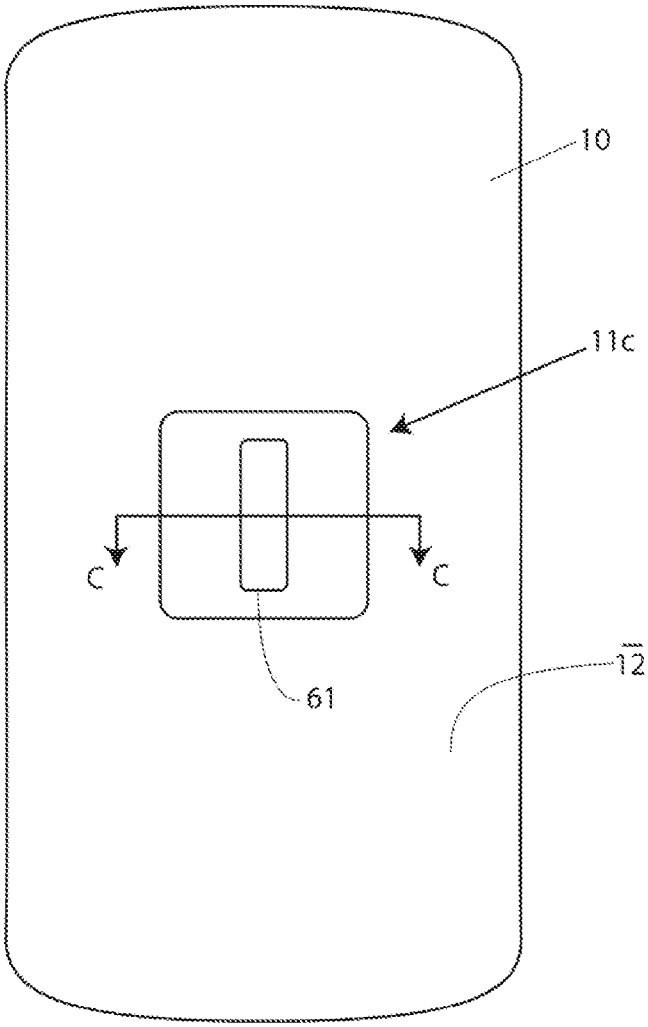
FIG. 6 is a plan view of a magnetic coupling device 11*b* affixed to surface 12 of host device 10, wherein magnetic coupling device (magnetic decal) 11*b* includes an aperture 61.

FIG. 6 illustrates an aperture 61 in magnetic coupling device 11*c* that provides a path for radio waves that may travel between a transceiver (not shown) in host device 10 and a communicating transceiver (not shown) in an attached releasable module such as module 30 of FIG. 4. In this case, device 10 may be a mobile device such as a smart phone, and communication between device 10 and module 30 may comprise near field communication, NFC, or BLUETOOTH, or ZIGBEE, or another method of radio communication. The communication may be in either direction.

Figure 7:
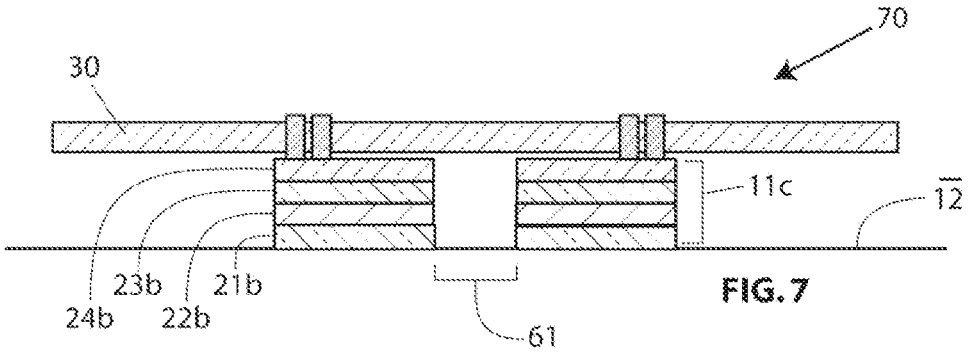
FIG. 7 is a cross-sectional view of section CC of FIG. 6, depicting magnetic attachment 70 comprising magnets 31 of contact array 32 that are magnetically coupled to magnetic coupling device 11*b*.

FIG. 7 depicts in cross-section a magnetic attachment 70 between releasable module 30 and receiving surface 12 of a host device, corresponding to section CC of FIG. 6. Aperture 61 of magnetic coupling device 11*c* of FIG. 6 is shown, providing a window through which radio waves may pass, unrestricted by the presence of attenuating layers 21*b*, 22*b*, 23*b*, and 24*b*, especially attenuating layer 22*b* which comprises a metallic material.

Figure 7B:
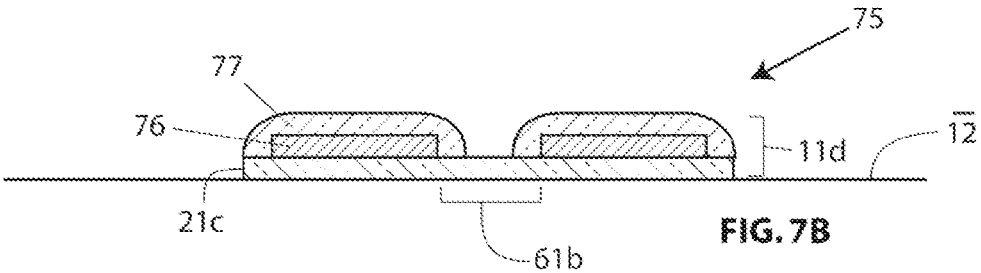
FIG. 7B is a cross-sectional view of a magnetic attachment 75 comprising a magnetic coupling device 11*d* in a molded configuration.

FIG. 7B illustrates a magnetic attachment 75 comprising magnetic coupling device 11*d*. Device 11*d* includes an aperture 61*b*, adhesive layer 21*c*, a magnetically permeable layer 76 formed in the shape of a toroid, and a molding 77 surrounding the toroid. Device 11*d* includes an adhesive layer 21*c*, a toroid 76 formed of magnetically permeable material, and a molding 77 of non electrically conducting material enclosing toroid 76. Aperture 61*b* through the metallic layer 76 is shown, providing a path for transmission of radio waves through device 11*d*.

Figure 8:
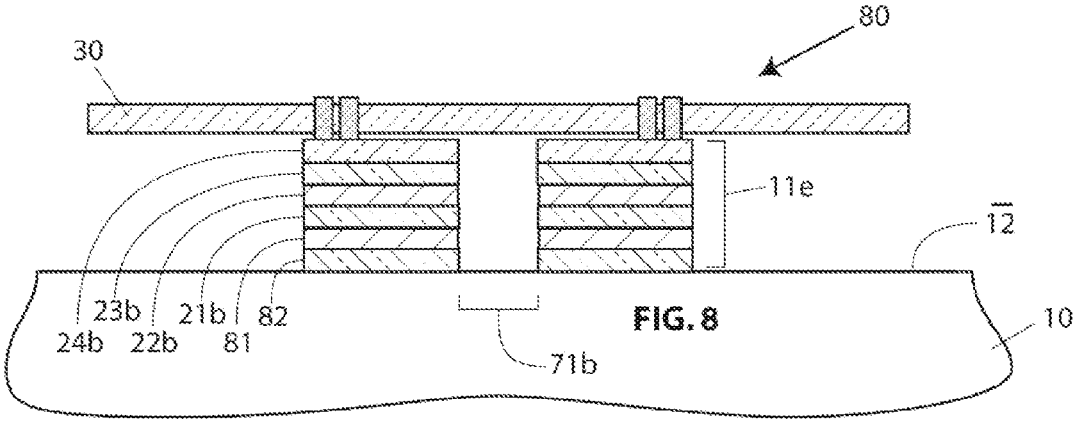
FIG. 8 is a cross-sectional view depicting magnetic attachment 80 wherein magnetic coupling device 11*e* comprises a plurality of magnetically permeable layers.

FIG. 8 shows a magnetic attachment 80 comprising magnetic coupling device 11*e*. Device 11*e* comprises layers 21*b*-24*b* as described in reference to FIG. 7. Device 11*e* also comprises an additional layer of magnetically permeable material 81 that is bonded to surface 12 using adhesive layer 82. Host 10 may employ sensitive magnetic instruments such as a magnetometer, and it may be important to eliminate or substantially reduce any magnetic effects inside host 10 due to the presence of magnets in an attached ancillary device. An example of such magnets that could cause interference is the magnetic contact array 31 of magnets 32 in releasable module 30, as previously described in reference to FIGS. 3-5. The additional layer 81 of magnetically permeable material may be used to reduce the effect of fringing magnetic fields produced by magnetic contact array 31 for example.

Figure 9:
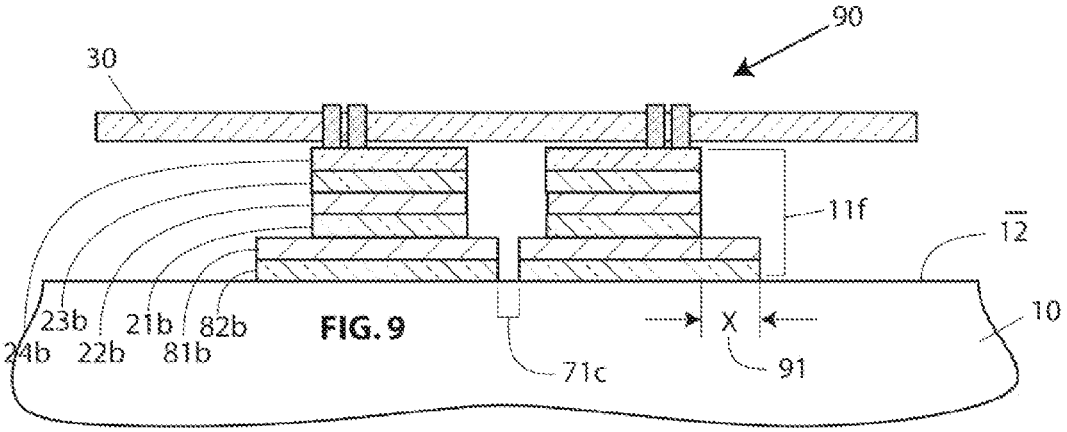
FIG. 9 is a cross-sectional view showing magnetic attachment 90 wherein magnetic coupling device 11*f* comprises a stacked configuration wherein a base layer of permeable material extends beyond an upper layer of permeable material.

FIG. 9 depicts a magnetic attachment 90 comprising a magnetic coupling device 11*f* that has the same layered configuration as shown for device 11*e* in FIG. 8. However, layer 81*b* in FIG. 9 is larger in area than layer 22*b*, and the extension X, 91 may assist in reducing magnetic effects due to magnetic contact array 31 inside host device 10.

Figure 10:
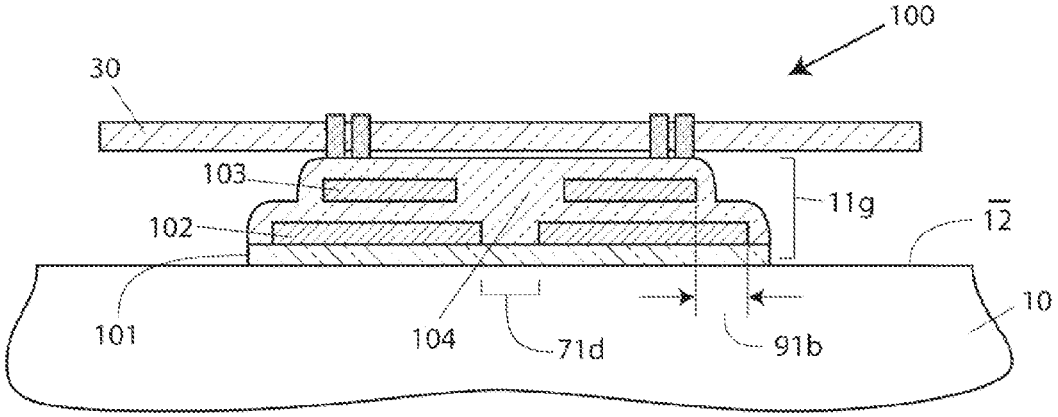
FIG. 10 is a cross-sectional view of magnetic attachment 100 wherein magnetic coupling device 11*f* comprises a molded configuration and a plurality of magnetically permeable toroids.

FIG. 10 shows magnetic attachment 100 comprising a magnetic coupling device 11*g* that also includes more than one layer of magnetically permeable material in order to reduce magnetic interference inside host device 10, due to magnets in releasable module 30 for example. Device 11*g* is configured with adhesive layer 101, a first toroid 102 of magnetically permeable material, and a second toroid 103 of magnetically permeable material, wherein toroid 103 has smaller dimensions than toroid 102. In particular toroid 102 includes extensions such as 91*b* relative to toroid 31, to reduce fringing magnetic fields produced by magnets in ancillary module 30.

Figure 11:
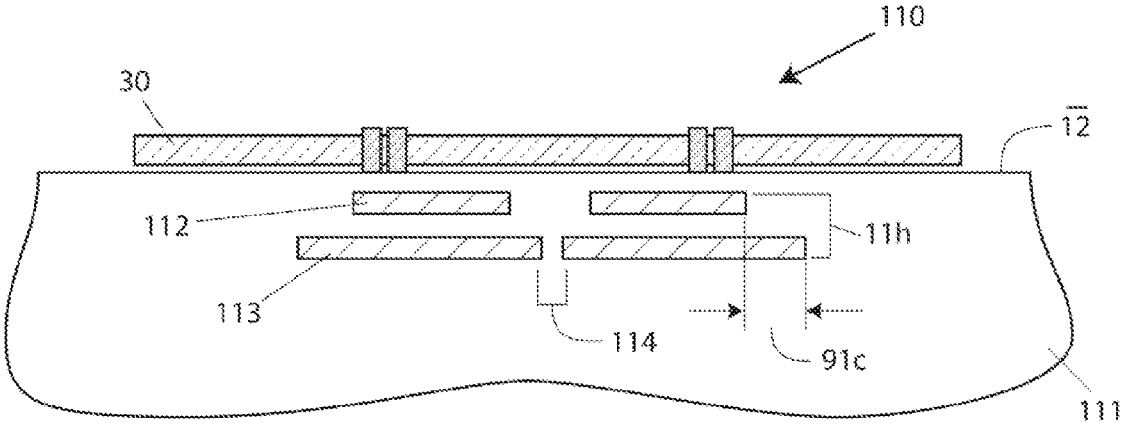
FIG. 11 is a cross-sectional view depicting magnetic attachment 110 wherein magnetic coupling device 11*h* is embedded in an enclosing shell 111 of a host device.

FIG. 11 illustrates magnetic attachment 110 comprising magnetic coupling device 11*h*. Device 11*h* is embedded in a non electrically conductive enclosure of host device 111, preferably formed of a plastic material. Device 11 may include an aperture 114 as shown, and a plurality of layers of magnetically permeable material, such as layers 112 and 113 in the figure. Toroid 113 may also include extended dimensions relative to toroid 112, such as offset dimension 91*c* in the figure.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A system comprising:

a host device;

a magnetic coupling device including:

a first adhesive layer coupled to the host device;

a first layer of magnetically permeable material attached to the first adhesive layer;

a second adhesive layer atop the first layer of magnetically permeable material; and a layer of non-electrically conductive material atop the second adhesive layer; and a releasable module including a base and a plurality of magnets coupled to the base, wherein the plurality of magnets couple the releasable module to the magnetic coupling device via magnetic attraction between the plurality of magnets and the first layer of magnetically permeable material.

2. The system of claim 1 further comprising: an aperture through the first layer of magnetically permeable material.

3. The system of claim 1 further comprising:

a second layer of magnetically permeable material.

4. The system of claim 3 wherein the first layer of magnetically permeable material is formed in the shape of a first toroid, the second layer of magnetically permeable material is formed in the shape of a second toroid, and the lateral dimensions of the first toroid extend beyond the lateral dimensions of the second toroid.

5. The system of claim 1 wherein the first layer of magnetically permeable material has a relative permeability of at least 75,000.

6. The system of claim 1 wherein the thickness of the first layer of magnetically permeable material is in the range of 0.25-1.0 mm.

7. The system of claim 1, wherein the host device is a mobile device.

8. The system of claim 7, wherein the mobile device is a smart phone.

9. The system of claim 1, wherein the host device is a docking station.

10. The system of claim 1, wherein at least one of the first adhesive layer or the second adhesive layer includes VHB adhesive.

11. The system of claim 1, wherein the first layer of magnetically permeable material includes mu metal or permalloy.

12. The system of claim 1, wherein the layer of non-electrically conductive material includes polycarbonate or polyacrylate.

13. The system of claim 1, wherein the plurality of magnets form a magnetic contact array.

14. The system of claim 1, wherein the plurality of magnets protrude beyond a surface of the releasable module.

15. The system of claim 1, wherein the plurality of magnets are electrical terminals of the releasable module.

16. The system of claim 1, wherein the plurality of magnets include neodymium.

* * * * *